US006876140B2

(12) United States Patent
Jeong et al.

(10) Patent No.: US 6,876,140 B2
(45) Date of Patent: Apr. 5, 2005

(54) FIELD EMISSION DISPLAY USING A GATED FIELD EMITTER AND A FLAT ELECTRODE

(75) Inventors: Hyo Soo Jeong, Seoul (KR); Gyung Rae Kim, Gumi-si (KR); Seong Min Jeon, Busan-si (KR)

(73) Assignee: LG. Philips Displays Korea Co., Ltd., Gyeongsangbuk-do (KR)

( * ) Notice: Subject to any disclaimer, the term of this patent is extended or adjusted under 35 U.S.C. 154(b) by 0 days.

(21) Appl. No.: 10/213,098

(22) Filed: Aug. 7, 2002

(65) Prior Publication Data

US 2003/0178934 A1 Sep. 25, 2003

(30) Foreign Application Priority Data

Mar. 25, 2002 (KR) ..... 2002-15945
Jun. 8, 2002 (KR) ..... 2002-32132

(51) Int. Cl.[7] ..... H01J 1/62
(52) U.S. Cl. ..... 313/495; 313/309
(58) Field of Search ..... 313/309, 336, 313/351, 495–497; 445/24, 25, 50, 51

(56) References Cited

U.S. PATENT DOCUMENTS 5,629,583 A * 5/1997 Jones et al. ..... 313/495
5,821,679 A * 10/1998 Makishima ..... 313/495
5,864,205 A 1/1999 Dworsky
5,955,850 A 9/1999 Yamaguchi et al.
5,973,451 A * 10/1999 Geis et al. ..... 313/495
6,137,213 A * 10/2000 Moyer et al. ..... 313/495
6,252,347 B1 6/2001 Breen et al.

FOREIGN PATENT DOCUMENTS

JP 6-139952 A 5/1994
JP 8-250032 A 9/1996
JP 08293270 11/1996
JP 2000-057979 A 2/2000

OTHER PUBLICATIONS

Komoda T et al: "Invited Paper: Fabrication of Ballistic Electron Surface–Emitting Display on Glass Substrate" 2001 SID International Symposium Digest of Technical Papers, San Jose, CA: vol. 32, Jun. 2001, pp. 188–191, XP001054077.

* cited by examiner

*Primary Examiner*—Joseph Williams
(74) *Attorney, Agent, or Firm*—Birch, Stewart, Kolasch & Birch, LLP

(57) ABSTRACT

The present invention relates to a field emission display using a gated field emitter and a flat electrode that is applied to a Cathode Ray Tube (CRT). The present invention does not need a spacer unlike the related invention and so the problem resulting from a mounting of the spacer is solved, and the structure of its whole panel and its fabrication process are simplified, thus improving its productivity and decreasing its fabrication cost.

42 Claims, 5 Drawing Sheets

FIELD EMISSION DISPLAY USING A GATED FIELD EMITTER AND A FLAT ELECTRODE

BACKGROUND OF THE INVENTION

1. Field of the Invention

The present invention relates generally to a field emission display, and more particularly to a field emission display using a gated field emitter and a flat electrode.

2. Description of the Related Art

In these days of multi media and technique development of information communication, an importance of the display device has been more emphasized than any times, thus requiring a flat display development having a light weight, a thin thickness, a low consumption power and a low cost.

For the flat display, there are a Liquid Crystal Display, a Field Emission Display and a Plasma Display Panel.

Nowadays, various flat displays reducing the weight and the volume, which are demerits of the CRT, has been developed.

Trials to develop as the flat display a slim CRT by applying elements using the filed emission phenomenon to the display are popular. This is advantageous in that its thickness is thin and its fabrication cost is low and an display quality is excellent like the related CRTs.

FIG. 1 is a cross sectional view of showing a related Field Emission Display.

With respect to FIG. 1, the related Field Emission Display (Japanese Laid Open 8-250032) includes a cathode plate 2 on which a field emitter 7, a gate electrode 6 and a cathode electrode 3 are formed; an anode plate 1 having a fluorescent screen 4; a plurality of spacer 8 allowing an interval between the cathode plate 2 and the anode plate 1 to be uniform; a frit glass 5 to be sealed along edges of the plates in order to maintain a space between the cathode plate 2 and the anode plate 1 to be vacuous. The cathode electrode 3 formed on the cathode plate 2 provides current for the field emitter 7 on the cathode electrode 3, and the gate is used as a lead electrode for leading electrons.

Additionally, elements of the field emitter 7 are formed above the cathode plate 2 to correspond to pixels of the anode plate 1, respectively.

When a voltage is applied to the gate electrode, an electric field is formed around the field emitter 7, and electrons are emitted from the field emitter 7 by the electric field.

That is, the field emitter 7 serves as an electron gun.

The electrons emitted from the field emitter are moved toward the anode plate 1 by a voltage between the anode plate 1 and the cathode plate 2, and these electrons collides with a fluorescent screen 4 formed at the anode plate 1.

A picture on the display is formed by using light emitted by that collision. In the above related field emission display, unlike the CRT, the interval between the cathode plate 2 and the anode plate 1 is about 1.5 mm, and so a high voltage needed for the display operation cannot be applied in this small space, thus being disadvantageous in that a life span of the fluorescent screen 4 is short and a display of high quality cannot be achieved. Additionally, the related field emission display is disadvantageous in that it is very difficult to maintain a high-vacuum state for a long time and so it is hard to make the large-sized display and its good reliance or its high quality display cannot be achieved.

Additionally, the interval between the cathode plate 2 and the anode plate 1 should maintain uniformly, and a plurality spacer 8 should be mounted in order to keep the vacuum state, and however a manufacture of the spacer 8, which is a miniature structure, and a mounting operation of the spacer 8 are so complicated.

Moreover, if the electrons collide with the spacer 8 during its operation, a "spacer charging" phenomenon occurs, and so electron beams are distorted and a high quality display cannot be achieved.

FIG. 2 is a cross sectional view of a related picture display. This figure is an invention of Japanese Laid Open 6-139952. This invention comprises an anode plate 1 of a vessel shape with a fluorescent screen 4; a cathode plate 2 having a cathode electrode 3; a thermal cathode 15 as a means for generating electron beams; an electron beams control means 14 for controlling the electron beams; a fixing means 17*a*, 17*b* for fixing the electron beam generating means; an insulating spacer 16*a*, 16*b* for maintaining an interval between the electron beams control means 14 and the cathode electrode 3. When electrons are emitted from the thermal cathode 15, the electron beams control means 14 consisting of a plurality of plate electrodes controls the electron beams. The electron beams controlled in a horizontal or vertical direction collide with the fluorescent screen 4 at an anode plate to generate light and to form a picture.

In this invention constructed as above, in order to control the electron beams, a plurality of the flat electrodes should be separated at uniform intervals, and however this process is very complicated to decrease its productivity.

Moreover, the more the size of the display is large, the more it is difficult to setup the electrodes, while its fabrication cost increases to prevent its mass production.

SUMMARY OF THE INVENTION

An object of the present invention is to provide a field emission display using a gated field emitter and a flat electrode.

To achieve the above object, there is provided a field emission display comprising a field emitter for emitting electrons by an electric field; a cathode plate having the field emitter on its surface; an anode plate being opposite to the cathode plate at a preset interval and having a fluorescent screen; a flat electrode having a plurality of holes for passing electron beams and being separated from the anode plate at a preset interval.

Wherein the flat electrode is fixed to the anode plate by an electrode supporter, and the anode plate and the cathode plate are separated from each other at the preset interval by a frame.

Unlike the related field emission display, the above field emission display of the present invention constructed as above does not need a spacer, and so the present invention solves the problem of a mounting of the spacer. Additionally, the structure of its whole panel and its fabrication process are simplified, thus improving its productivity and decreasing its fabrication cost.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Hereinafter, a preferred embodiment of the field emission display according to the present invention will be described with respect to the accompanying drawings.

Figure 1:
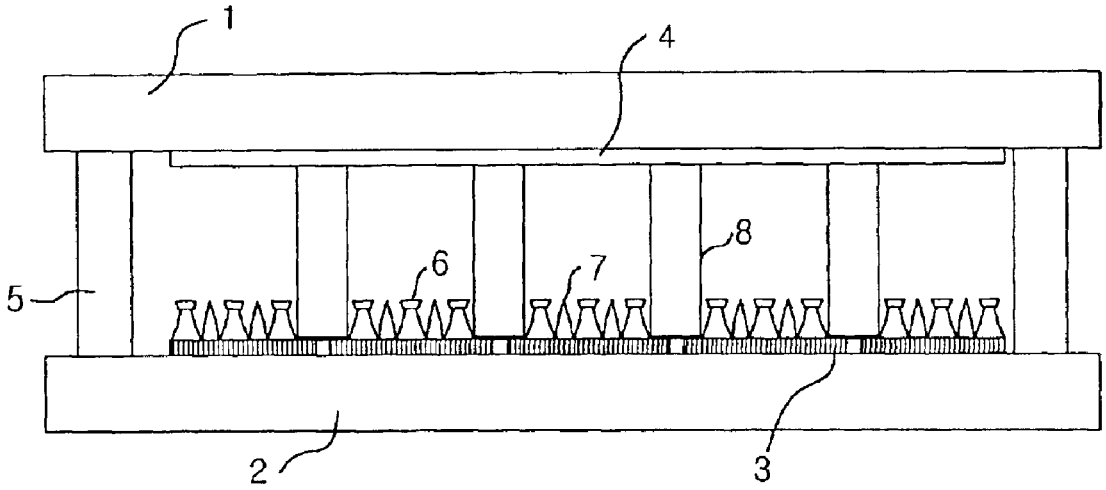
FIG . 1 (Related art)
FIG. 1 is a cross sectional view of showing a related Field Emission Display.
Figure 2:
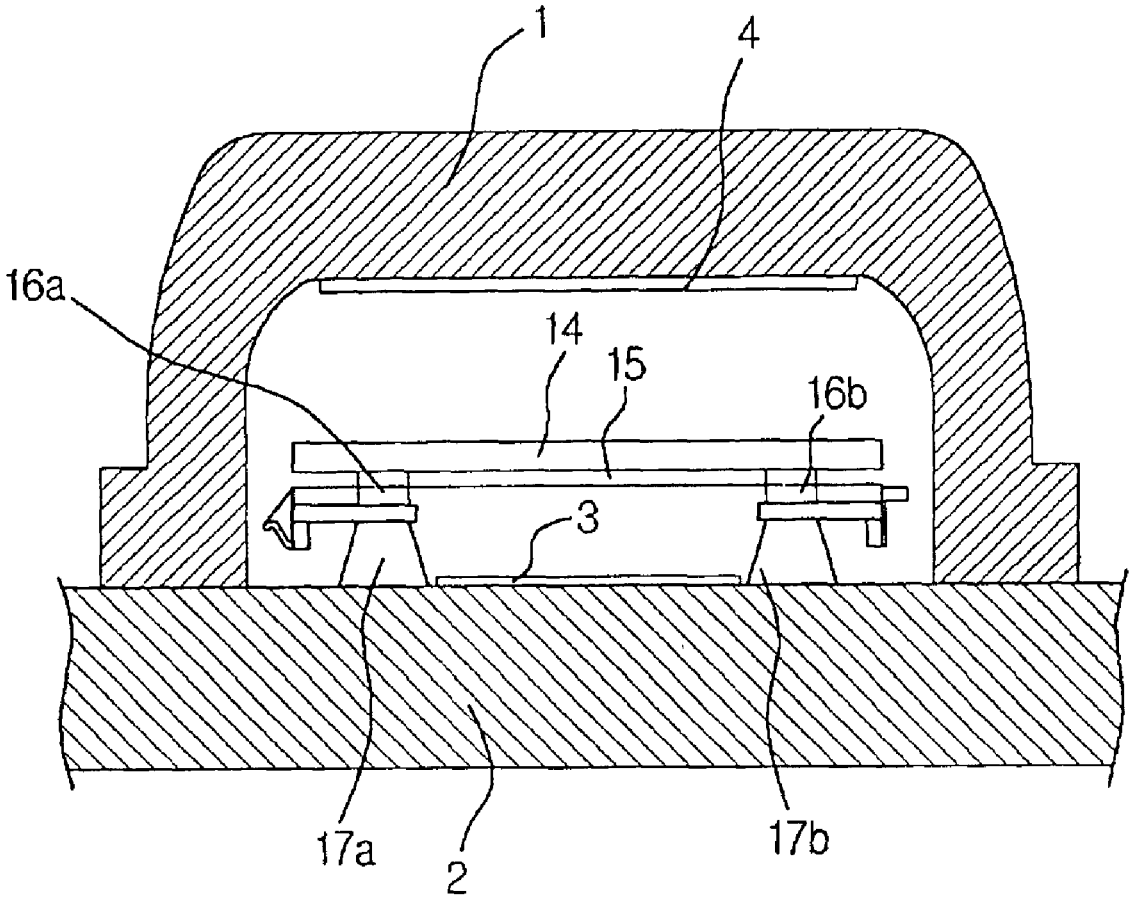
FIG . 2 (Related art)
FIG. 2 is a cross sectional view of a related picture display.
Figure 3:
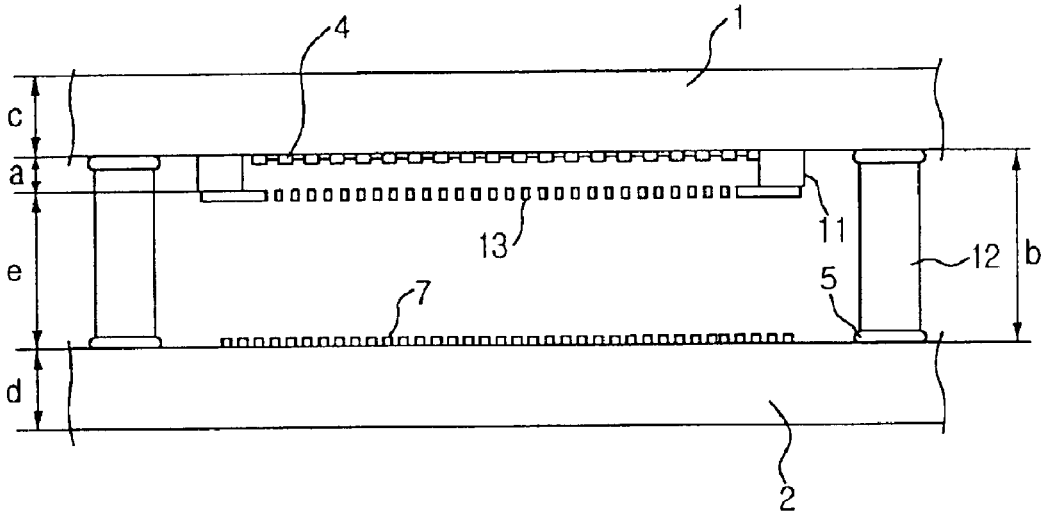
FIG. 3 is a cross sectional view of the field emission display of the present invention.

The same reference numerals are used to designate components of the field emission display of the present invention which are similar components or same components as the related display FIG. 3 is a cross sectional view of the field emission display employing a flat electrode of the present invention.

As shown in FIG. 3, the field emission display employing the flat electrode of the present invention includes a cathode plate 2 having a field emitter 7 for emitting electrons by an electric field, and an anode plate being opposite to the cathode plate 2 at a preset interval and having a fluorescent screen 4. The cathode plate 2 and the anode plate 1 are separated at a regular interval by a frame 12. An electrode supporter 11 is attached to the anode plate 1 by a frit glass, etc., and at the electrode supporter, a flat electrode 13 having a plurality of holes for passing electron beams is separated from the anode plate 1 at a preset interval.

That is, an end of the electrode supporter 11 is fixed to the anode plate 1 and the other end is welded to the flat electrode 13, and so the anode plate 1 and the flat electrode 13 are supported at the preset interval.

More specially, for the field emitter 7, a flat type emitter is used which has an excellent property of the straight and a low fabrication cost, and an emitter of a tip shape having convergence electrodes, a Ballistic Surface electron emitter Display emitter, a MIM (Metal/Insulator/Metal) emitter, and SCE (Surface Conduction Electron) emitter are used. Additionally, in case a property of the straight of the field emitter is not good, the convergence electrodes are employed to improve the property of the straight of electrons.

That is, in case the emitter of the tip shape is used, a spread phenomenon of the electron beams occurs when a moving distance of the electron beams is far, and so the convergence electrodes for preventing the spread of the beams are used.

Preferably, for the field emitter 7, a gated field emitter of 3 poles structure is suitable which has a good property of the straight.

Additionally, the cathode plate 2 having the field emitter is opposite to the anode plate 1, and separated at a regular interval by the frame 12.

The frame 12 has a uniform width and height, and is inserted as a rectangular frame between the cathode plate 2 and the anode plate 1 along edges of the anode plate 1 and the cathode plate 2.

More preferably, inside edges of the frame 12 is formed smoothly in order to prevent the concentration of an electric field.

Both sides of the frame 12 are sealed with the cathode plate 2 and the anode plate 1 by the frit glass 5.

In this way, because of the sealing, a space between the cathode plate 2 and the anode plate 1 maintains to be a vacuum state.

For a thickness d of the cathode plate 2 and a thickness c of the anode plate 1, more than 10 mm is preferable in order to maintain the space between the cathode plate 2 and the anode plate 1 to be in a high vacuum and to ensure a solidity of the display.

Additionally, for the interval b between the cathode plate 2 and the anode plate 1, 3 mm to 50 mm is preferable in order to allow a high voltage to be applied to the anode plate 1 and to maintain a conductance and a high vacuum in the panel.

Additionally, for an interval e between the cathode plate 2 and the flat electrode 13, less than 30 mm is preferable, considering the straight of the electron beams emitted from the field emitter 7.

Additionally, for the frame 12, the same material as the cathode plate 2 and the anode plate 1 is suitable, and specially, the same material having the same heat extension/contraction rate is suitable.

The flat electrode 13 is separated from the fluorescent screen 4 at a preset interval and is positioned horizontally.

Additionally, the flat electrode 13 is welded to the electrode supporter 11.

In case a winding is formed in the flat electrode 13, the electrons gather concentrically in a certain portion, and so the field emission display of the present invention cannot be well operated.

Accordingly, it is important to arrange the flat electrode 13 to be horizontal with the field emitter 7 and the fluorescent screen 4.

Additionally, the flat electrode 13 has a function of distinguishing selectively the electron beams and a function of drawing the electrons toward the anode plate 1.

The flat electrode 13 is to block a backward scattering, and metal is suitable for its material.

The "backward scattering" of the electron beams means that the electron beams that have collided with an element of the fluorescent screen 4 are rejected and collide with another element of the fluorescent screen to reduce color purity and a contrast of the display.

The nearer is the flat electrode 13 and the fluorescent screen 4 to each other, the better blocks the flat electrode 13 the backward scattering of the electrons. However, it is in difficulty to make them to be nearer to each other.

Accordingly, for an interval a between the anode plate 1 and the flat electrode 13, 0.5~20 mm is preferable in order to efficiently block the backward scattering of the electrons by the flat electrode 13.

Preferably, as the flat electrode 13, a flat tension mask is suitable.

The flat tension mask is formed at a preset interval from the fluorescent screen 4 of the anode plate 1, and the flat tension mask means a uniformly extended flat mask.

An operation of the field emission display employing the flat electrode of the present invention constructed as above is as follows.

If an electric field is formed at a gate (not shown), electrons are emitted from the field emitter 7.

The gate performs a signal modulation, and it is preferred that a low voltage is applied to the gate.

The emitted electrons pass, via a vacuum medium, the flat electrode 13 to which the same voltage as the anode electrode is applied, and collide with the fluorescent screen 4 formed at the anode plate 1 to make the fluorescent screen 4 to radiate and to form a picture.

In this case, components of the field emitter 7 correspond to pixels of the picture, respectively. The electrons emitted from the field emitter 7 are selectively distinguished at the flat electrode 13 to collide correctly with the fluorescent screen 4.

Figure 4:
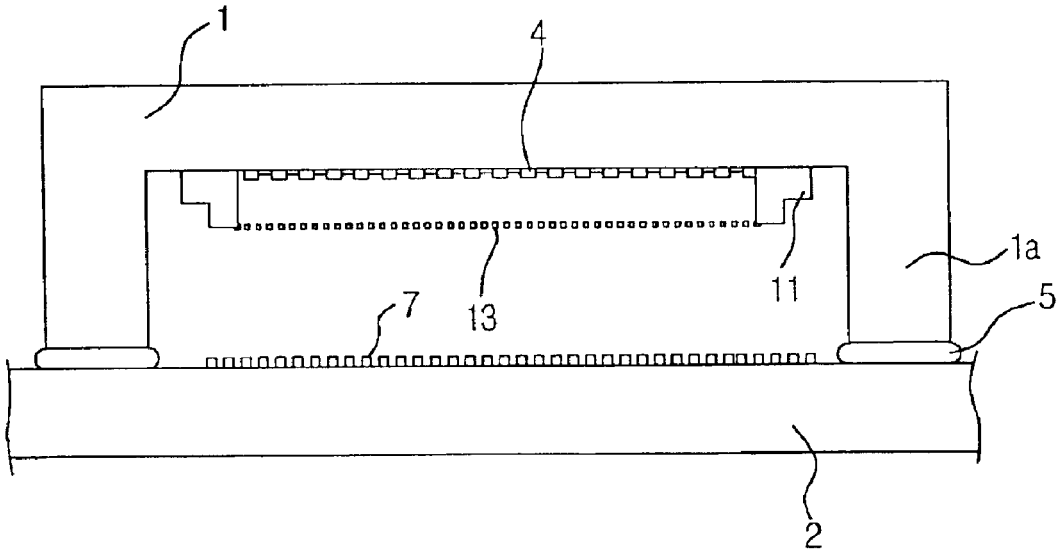
FIG. 4 is a cross sectional view of another embodiment of the field emission display of the present invention.

FIG. 4 is a cross sectional view of another embodiment of the field emission display of the present invention.

Unlike FIG. 3, the field emission display of the present invention in FIG. 4, a field emitter 7 for emitting electrons by an electric field; a cathode plate 2 having the field emitter 7 on its surface; an anode plate 1 having the fluorescent screen 4, which is formed on an opposite side to the cathode plate, and a supporting part 1*a* to allow the anode plate to be separated from the cathode plate 2 at a preset interval; a flat electrode 13 having a plurality of holes for passing electron beams which is separated from the fluorescent screen 4 of the anode plate 1 at a preset interval; an electrode supporter 11 for allowing the flat electrode 13 to be attached to the anode plate 1 at a preset interval.

Unlike the embodiment of FIG. 3, in this embodiment of FIG. 4, the anode plate 1 is provided with the supporting part 1*a* to allow the anode plate to be separated from the cathode plate 2 at the preset interval. The supporting part 1*a* is sealed with the cathode plate 2 by a frit glass 5.

Additionally, inside edges of the supporting part 1*a* is formed smoothly in order to prevent a concentration of the electric field. That is, this embodiment has the supporting part 1*a* to allow the anode plate 1 to be separated from the cathode plate 2 at the preset interval, thus simplifying the sealing process to increase its productivity and improving a reliance of the display due to the simplified structure.

Figure 5:
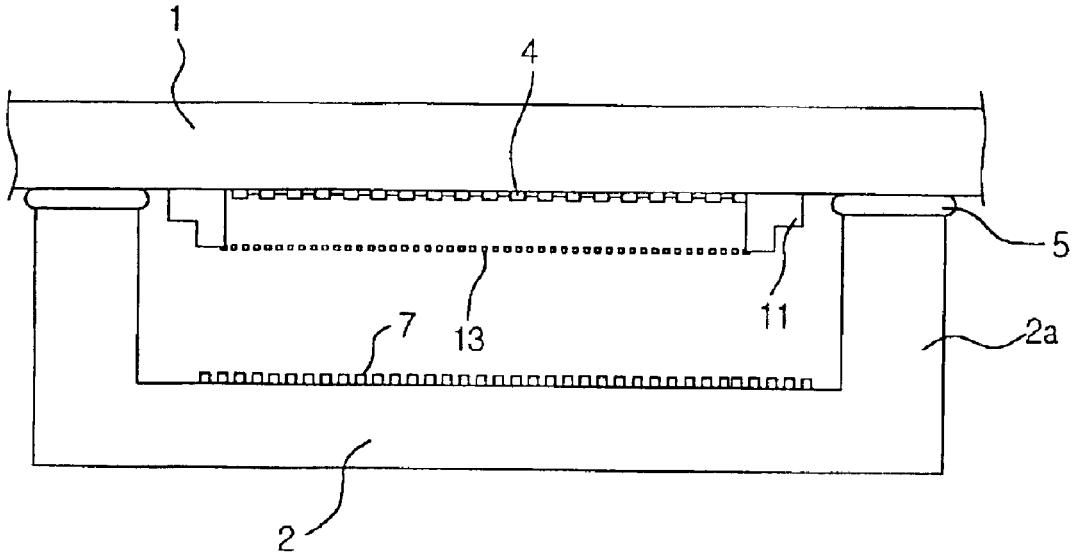
FIG. 5 is a cross sectional view of another embodiment of the field emission display of the present invention.

FIG. 5 is a cross sectional view of another embodiment of the field emission display of the present invention. This embodiment of FIG. 5 comprises an anode plate 1 having a fluorescent screen 4; a cathode plate 2 having a field emitter 7 formed on an opposite side to the anode plate 1 and a supporting part 2*a* to allow the cathode plate to be separated from the anode plate 1 at a preset interval; a flat electrode 13 having a plurality of holes for passing electron beams which is separated from the fluorescent screen 4 of the anode plate 1 at a preset interval; and an electrode supporter 11 for allowing the flat electrode 13 to be attached to the anode plate 1 at a preset interval.

In this embodiment of FIG. 5, unlike the embodiment of FIG. 4, the cathode plate 2 is provided with a supporting part 2*a* to allow the cathode plate 2 to be separated from the anode plate at the preset interval.

The supporting part 2*a* is sealed with the anode plate 1 by the frit glass 5.

Additionally, inside edges of the supporting part 2*a* is formed smoothly in order to prevent a concentration of an electric field.

That is, this embodiment has the supporting part 2*a* to allow the anode plate 1 to be separated from the cathode plate 2 at the preset interval, thus simplifying the sealing process to increase its productivity and improving a reliance of the display due to the simplified structure.

Figure 6:
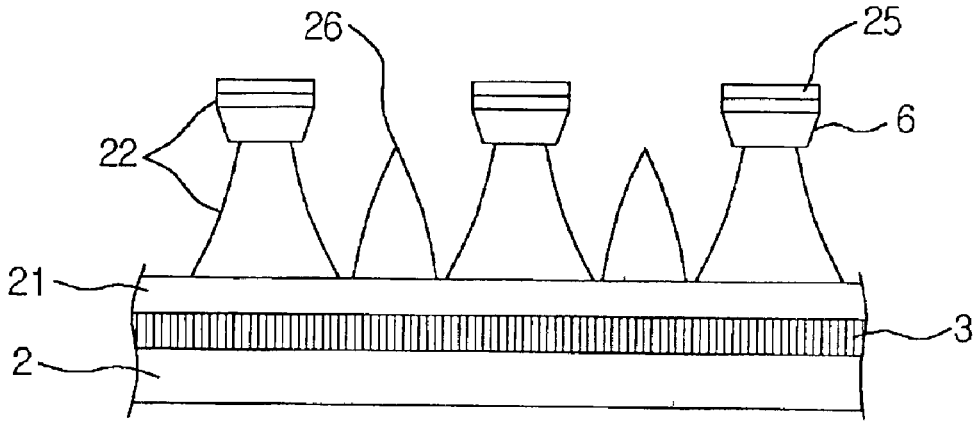
FIG. 6 is a cross sectional view of the gated field emitter of a tip type having convergence electrodes.

FIG. 6 is a cross sectional view of the gated field emitter of a tip type having convergence electrodes which can be applied as the field emitter of the present invention.

With respect to FIG. 6, the gated field emitter of the tip type is provided with a cathode electrode 3 and a resistance layer 21 on the cathode plate 2, and a micro tip 26, an insulating layer 22 and a gate electrode 6, and convergence electrodes 25 are formed in the upper part.

The gated field emitter of the tip type uses an electric field emission that electrons are emitted from the micro tip 26 by positioning the gate electrode 6 adjacent to the micro tip 26 to form an electric field.

The resistance layer 21 is included at a lower side of the emitter for a uniformity of the current density.

Additionally, in the above tip type emitter, a spread phenomenon more occurs as a moving distance of the electron beams is long, and so convergence electrodes 25 for preventing the beam spread is needed.

The electrons emitted from the microchip 26 are accelerated by an electric field between the cathode electrode 3 and the anode electrode (now shown), and collide with the fluorescent screen 4 formed on the anode electrode.

The fluorescent screen 4 is radiated by that collision, and so a picture is formed. As above, the gated field emitter of the tip type having the structure of the convergence electrodes being applied as a field emitter of the present invention has a long development history, and its various forms have been developed, and its fabrication technology has been well established.

Figure 7:
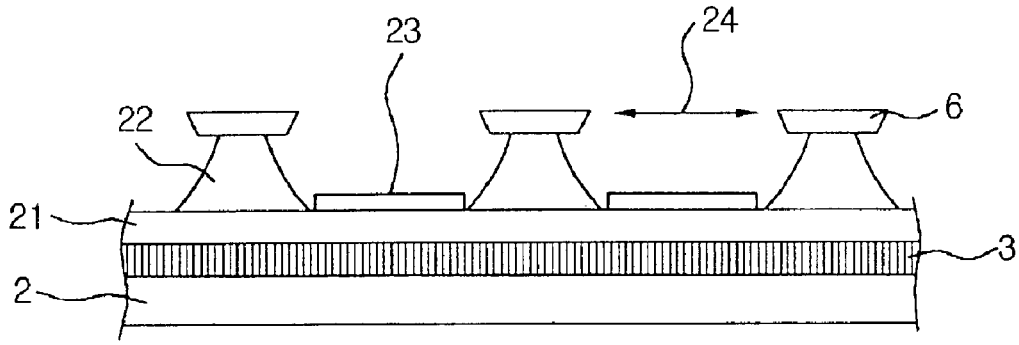
FIG. 7 is a cross sectional view of the flat type gated field emitter.

FIG. 7 is a cross sectional view of the flat type gated field emitter which can be applied as the field emitter of the present invention.

With respect to FIG. 7, the flat type gated field emitter is provided with a cathode electrode 3 and a resistance layer 21 on the cathode plate 2, and a flat type emitter 23, an insulating layer 22 and a gate electrode 6, and gate electrode 6 and a gate aperture 24 are formed in the upper part. For a gate aperture 24, less than 0.1 $\mu$m is preferable.

Additionally, the above flat type emitter has the convergence electrodes for compensating the spread phenomenon of the electron beams.

For the above flat type emitter, carbon based materials are mainly used. This flat type emitter that can be applied as a field emitter of the present invention also has a long development history, and its various forms have been developed, and its fabrication technology has been well established.

Figure 8:
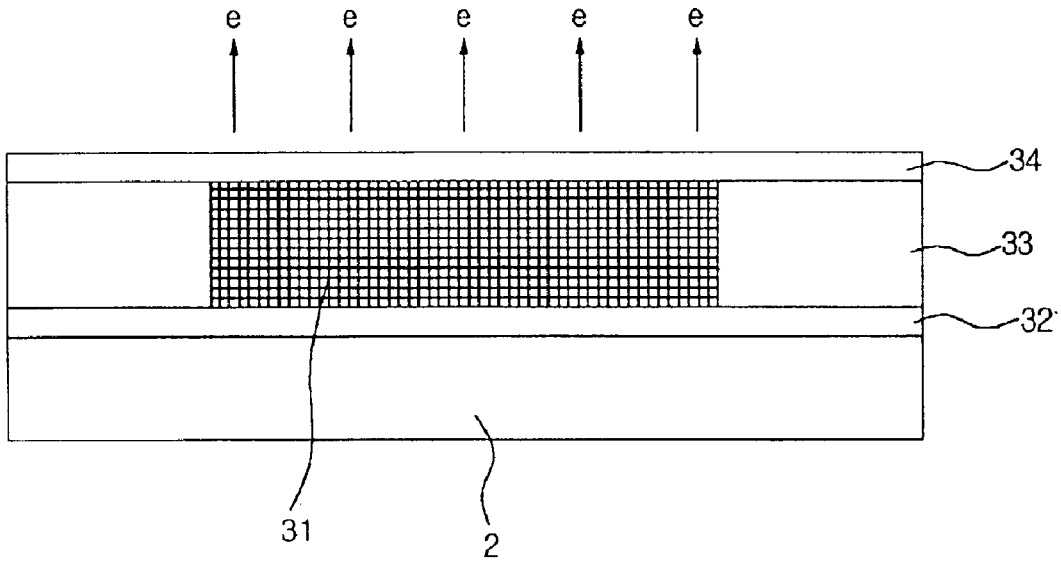
FIG. 8 is a cross sectional view of a Ballistic Surface electron emitter Display emitter.

FIG. 8 is a cross sectional view of a Ballistic Surface electron emitter Display emitter which can be applied as the field emitter of the present invention.

Describing with respect, to FIG. 8, a lower electrode 32 and a surface electrode 34 are formed on the cathode plate 2, and a poly Si 33 and a nanocrystalline porous poly Si 31 are formed between the lower electrode 32 and the surface electrode 34.

The above BSD emitter which is a typical flat type emitter is an easy structure to make a 3-pole structure, and the surface electrode 34 serves as a gate.

Additionally, the poly Si 33 forms an insulating layer, and the nanocrystalline porous poly Si 31 is a passage of electrons as an insulating material.

Additionally, the BSD emitter has an excellent property of the straight, and it has a characteristic that the electron beams go forth not spreading even in the interval of more than 5 mm in a vertical direction.

Accordingly, the BSD emitter does not need the convergence electrodes.

The above field emission display employing the flat electrode according to the present invention does not need a spacer, unlike the related field emission display, and so in the present invention the problem of a manufacture and a mounting of the spacer, which is a miniature spacer, are solved Additionally, the structure of its whole panel and its fabrication process are simplified, thus improving its productivity and decreasing its fabrication cost.

Additionally, the interval between the cathode plate and the anode plate can be easily widen in comparison to the related field emission display, and so a space in the panel is widen to improve its conductance and to maintain a high vacuum, thus improving its reliance.

Additionally, due to the widen interval, a high voltage can be easily applied to the anode electrode, and so a picture of high brightness can be achieved.

In addition, due to the application of the high voltage, a life span of the fluorescent screen and the display are assured.

Meanwhile, the present invention is not limited to the above embodiments, and those skilled in the art will appreciate that various modifications, that a kind of the field emitter is changed or separate convergence electrodes are included to support the property of the straight of the electron beams, are possible, without departing from the scope and spirit of the invention as disclosed in the accompanying claims.

What is claimed is:

1. A field emission display, for displaying a picture on a display area by using light emitted by collision, comprising:

a field emitter for emitting electrons by an electric field;

a cathode plate having the field emitter on its surface;

an anode plate being opposite to the cathode plate at a preset interval and having a fluorescent screen;

a flat electrode having a plurality of holes for passing electron beams and being separated from the anode plate at a single preset interval along substantially the entire surface of the electrode facing the display area.

2. The field emission display according to claim 1, wherein the flat electrode is a flat tension mask.

3. The field emission display according to claim 1, wherein the field emitter is a gated field emitter of a tip shape having an insulating layer, a gate electrode and convergence electrodes.

4. The field emission display according to claim 1, wherein the field emitter is a flat type gated field emitter having an insulating layer, a gate electrode and convergence electrodes.

5. The field emission display according to claim 1, wherein the field emitter is a Ballistic Surface electron emitter Display (BSD) emitter.

6. The field emission display according to claim 1, further including an electrode supporter for allowing the flat electrode to be fixed to the anode plate at the preset interval.

7. The field emission display according to claim 6, wherein the flat electrode is welded to the electrode supporter.

8. The field emission display according to claim 6, wherein the electrode supporter is fixed to the anode plate by frit glass.

9. The field emission display according to claim 1, further including a frame for allowing the cathode plate and the anode plate to be separated at the preset interval.

10. The field emission display according to claim 9, wherein the frame are sealed with the cathode plate and the anode plate.

11. The field emission display according to claim 9, wherein the frame is in a shape of a rectangular frame.

12. The field emission display according to claim 11, wherein inside edges of the frame are formed smoothly.

13. The field emission display according to claim 1, wherein the flat electrode is separated from the anode plate at the interval of 0.5 mm to 20 mm.

14. The field emission display according to claim 1, wherein a thickness of the cathode plate is more than 10 mm.

15. The field emission display according to claim 1, wherein a thickness of the anode plate is more than 10 mm.

16. The field emission display according to claim 1, wherein the interval between the cathode plate and the anode plate is 3 mm to 50 mm.

17. The field emission display according to claim 1, wherein the interval between the cathode plate and the anode plate is less than 30 mm.

18. A field emission display, for displaying a picture on a display area by using light emitted by collision, comprising:

a field emitter for emitting electrons by an electric field;

a cathode plate having the field emitter on its surface;

an anode plate being opposite to the cathode plate at a preset interval and having a fluorescent screen;

a flat electrode having a plurality of holes for passing electron beams and being separated from the anode plate at a single preset interval along substantially the entire surface of the electrode facing the display area, wherein the flat electrode is fixed to the anode plate by an electrode supporter, and the anode plate and the cathode plate are separated from each other at the preset interval by a frame.

19. The field emission display according to claim 18, wherein the flat electrode is a flat tension mask.

20. The field emission display according to claim 18, wherein the field emitter is a gated field emitter of a tip shape having an insulating layer, a gate electrode and convergence electrodes.

21. The field emission display according to claim 18, wherein the field emitter is a flat type gated field emitter having an insulating layer, a gate electrode and convergence electrodes.

22. The field emission display according to claim 18, wherein the field emitter is a Ballistic Surface electron emitter Display (BSD) emitter.

23. The field emission display according to claim 18, wherein the flat electrode is welded to the electrode supporter.

24. The field emission display according to claim 18, wherein the electrode supporter is fixed to the anode plate by frit glass.

25. The field emission display according to claim 18, wherein the frame are sealed with the cathode plate and the anode plate.

26. The field emission display according to claim 18, wherein the frame is in a shape of a rectangular frame.

27. The field emission display according to claim 26, wherein inside edges of the frame are formed smoothly.

28. The field emission display according to claim 18, wherein the flat electrode is separated from the anode plate at the interval of 0.5 mm to 20 mm.

29. The field emission display according to claim 18, wherein a thickness of the cathode plate is more than 10 mm.

30. The field emission display according to claim 18, wherein a thickness of the anode plate is more than 10 mm.

31. The field emission display according to claim 18, wherein the interval between the cathode plate and the anode plate is 3 mm to 50 mm.

32. The field emission display according to claim 18, wherein the interval between the cathode plate and the anode plate is less than 30 mm.

33. A field emission display, for displaying a picture on a display area by using light emitted by collision, comprising:

a field emitter for emitting electrons by an electric field;

a cathode plate having the field emitter on its surface;

an anode plate having a fluorescent screen, which is formed on an opposite side to the cathode plate, and a supporting part to allow the anode plate to be separated from the cathode plate at a preset interval;

a flat electrode having a plurality of holes for passing electron beams and being separated from the fluorescent screen of the anode plate at a single preset interval along substantially the entire surface of the electrode facing the display area; and an electrode supporter for allowing the flat electrode to be attached to the anode plate at a preset interval.

34. The field emission display according to claim 33, wherein the flat electrode is a flat tension mask.

35. The field emission display according to claim 33, wherein the field emitter is a gated field emitter of a tip shape having an insulating layer, a gate electrode and convergence electrodes.

36. The field emission display according to claim 33, wherein the field emitter is a flat type gated field emitter having an insulating layer, a gate electrode and convergence electrodes.

37. The field emission display according to claim 33, wherein the field emitter is a Ballistic Surface electron emitter Display (BSD) emitter.

38. The field emission display according to claim 33, wherein the flat electrode is welded to the electrode supporter.

39. The field emission display according to claim 33, wherein the electrode supporter is fixed to the anode plate by frit glass.

40. The field emission display according to claim 33, wherein the supporting part is sealed with the cathode plate.

41. The field emission display according to claim 33, wherein inside edges of the supporting part are formed smoothly.

42. A field emission display, for displaying a picture on a display area by using light emitted by collision, comprising:

an anode plate having a fluorescent screen;

a cathode plate having a field emitter formed on an opposite side to the anode plate and a supporting part to allow the cathode plate to be separated from the anode plate at a preset interval;

a flat electrode having a plurality of holes for passing electron beams which is separated from the fluorescent screen of the anode plate at a single preset interval along substantially the entire surface of the electrode facing the display area; and an electrode supporter for allowing the flat electrode to be attached to the anode plate at a preset interval.

* * * * *